US006516851B1

(12) United States Patent
Thatcher et al.

(10) Patent No.: US 6,516,851 B1
(45) Date of Patent: Feb. 11, 2003

(54) MACHINE AND METHOD FOR APPLYING PRESSURE SENSITIVE LABELS

(75) Inventors: Thomas Thatcher, Strongsville, OH (US); Jason Ashworth, Medina, OH (US); Joseph Yatsko, Hinckley, OH (US)

(73) Assignee: Tharo Systems, Inc., Brunswick, OH (US)

( * ) Notice: Subject to any disclaimer, the term of this patent is extended or adjusted under 35 U.S.C. 154(b) by 0 days.

(21) Appl. No.: 09/853,947

(22) Filed: May 14, 2001

(51) Int. Cl.[7] ..... G05G 15/00; B44C 1/16; B30B 7/00; B65B 9/42; B65B 9/40

(52) U.S. Cl. ..... 156/357; 156/350; 156/362; 156/540; 156/541; 156/542; 156/580; 156/DIG. 1; 156/DIG. 28; 156/DIG. 31

(58) Field of Search ..... 156/356, 384, 156/357, 362, 540, 541, 542, DIG. 1, DIG. 3, DIG. 5, DIG. 28, DIG. 16, DIG. 31, 580

(56) References Cited

U.S. PATENT DOCUMENTS 3,483,059 A * 12/1969 Dinter ..... 156/364
3,616,016 A * 10/1971 Dinter ..... 156/542
3,984,277 A * 10/1976 French et al. ..... 156/497
4,314,869 A * 2/1982 Crankshaw ..... 156/542
4,337,108 A * 6/1982 Crankshaw et al. ..... 156/542
4,468,274 A * 8/1984 Adachi ..... 156/320
4,680,082 A * 7/1987 Kearney ..... 156/497
5,421,948 A * 6/1995 Crankshaw et al. ..... 156/486
5,660,676 A * 8/1997 Brooks ..... 156/361
5,785,798 A * 7/1998 Horsman et al. ..... 156/361
5,988,251 A * 11/1999 Hunt et al. ..... 156/539

FOREIGN PATENT DOCUMENTS

EP 837000 A1 * 4/1998 ..... B65C/9/36

* cited by examiner

*Primary Examiner*—J. A. Lorengo
(74) *Attorney, Agent, or Firm*—Donald A. Bergquist

(57) ABSTRACT

Apparatus and method for automatically and with precision applying each of a series of individual self-adhesive labels from a continuous liner transporting labels at a first linear speed, each label being applied to one of a series of individual cartons moving at intervals at a second linear speed different from the first linear speed and wherein each label is applied at a selectable and reproducible preset distance from the leading edge of each carton. Each label is advanced to a parked position on a fan box, being partially dispensed thereon and further advanced by the liner to a pinch point for wiping the label onto a passing carton, this second advancing being timed for "just-in-time" delivery of the label to the pinch point to position the label along the length of the carton.

5 Claims, 3 Drawing Sheets

MACHINE AND METHOD FOR APPLYING PRESSURE SENSITIVE LABELS

BACKGROUND OF THE INVENTION

This invention relates to the field of labeling machines. More particularly, it relates to a simplified apparatus and method for merge labeling using a wipe applicator wherein the linear speed of the article to be labeled is different from the linear speed at which the label delivery mechanism can operate.

In the prior art relating to apparatus for merge labeling, the linear speed at which the label can be delivered is often limited by the rate at which a printing device can print necessary information to the label before it is applied to the article to be labeled. This may be especially true in merge labeling of labeling cartons for mailing or distribution, where each label may be printed with information specific to the carton being delivered to the labeling station. Such labeling has in the past required either that the label always be applied adjacent to a leading edge of the carton to be labeled, or that some complex mechanism as a piston or a timed air blast be used to quickly transfer the label from a fan box after the label is peeled completely from a continuous backing sheet, called a liner. The liner is advanced one label-length at a time across a sharp edge, creating a peel line, to fully disengage the label from the liner, depositing the label either onto a fan box from which it may be blown onto the carton or onto a vacuum pad carried by a piston that mechanically transfers the label to the carton.

In applications wherein such mechanisms are not used and a peeling mechanism merely feeds the label to a pinch point, labeling problems can develop if the carton to be labeled is moving at a faster speed than the feed rate of the liner. Synchronizing the speed of the conveyer carrying the cartons to be labeled with the speed of the feed rate of the liner is often problematical. Imprecise synchronizing can lead to torn labels or labels that are misapplied, either of which condition is considered an unacceptable result. The label or the liner can be torn if the label has a large area still adhered to the liner when the label adhesive suddenly makes sufficiently strong contact with the carton to suddenly pull the label from the liner or the sudden pull may yank on the liner sufficiently to upset the printing mechanism upstream from the peel line.

SUMMARY OF THE INVENTION

Thus, it is an object of this invention to provide in a merge-labeling operation a simplified apparatus and method for automatically and with precision applying each of a series of individual self-adhesive labels from a continuous liner transporting labels at a first linear speed, each label being applied to one of a series of individual cartons moving past a labeling station at intervals at a second linear speed different from said first linear speed and wherein each said label is applied at a selectable and reproducible preset distance from the leading edge of each carton.

It is an object of this invention to provide apparatus whereby a self-adhesive label having a leading edge and a trailing edge and carried on a continuous liner is by a first advancement of said liner partially disengaged onto a fan box from said liner that transports labels at a first linear speed, said first advancement leaving said trailing edge still attached to said liner, and by a second advancement of said liner, said label is subsequently further disengaged therefrom by advancing said liner, thereby advancing said leading edge to engage a carton moving at a second linear speed different from said first linear speed, and almost simultaneously disengaging said trailing edge from said liner.

It is an object of this invention to provide apparatus whereby a self-adhesive label having a leading edge and a trailing edge and carried on a continuous liner is by a first advancement of said liner partially disengaged onto a fan box from said liner that transports labels at a first linear speed, said first advancement leaving said trailing edge still attached to said liner, and by a second advancement of said liner, said label is subsequently further disengaged therefrom by advancing said liner, thereby advancing said leading edge to engage a carton moving at a second, linear speed different from said first linear speed, and almost simultaneously disengaging said trailing edge from said liner and wherein each label being applied to one of a series of individual cartons moving at intervals at a second linear speed different from said first linear speed and said apparatus includes a triggering means that initiates said second advancement wherein each said label is applied at a selectable and reproducible preset distance from the leading edge of each carton.

DETAILED DESCRIPTION

This invention relates to providing the ability to use simple merge labeling apparatus to repeatedly and with precision position a label at any desired location along the length of a carton, not just adjacent the leading edge thereof, and to accomplish this goal without the use of pistons or air blasts that have been used by other inventors. The greatest advantage comes from the fact that the linear speed of the conveyer belt carrying cartons to be labeled is not limited in any way by the linear speed of the liner transporting the labels, as is true in prior art apparatus that do not involve complicated pistons, linkages, or air-blast mechanisms for transferring a label to a carton.

Figure 1:
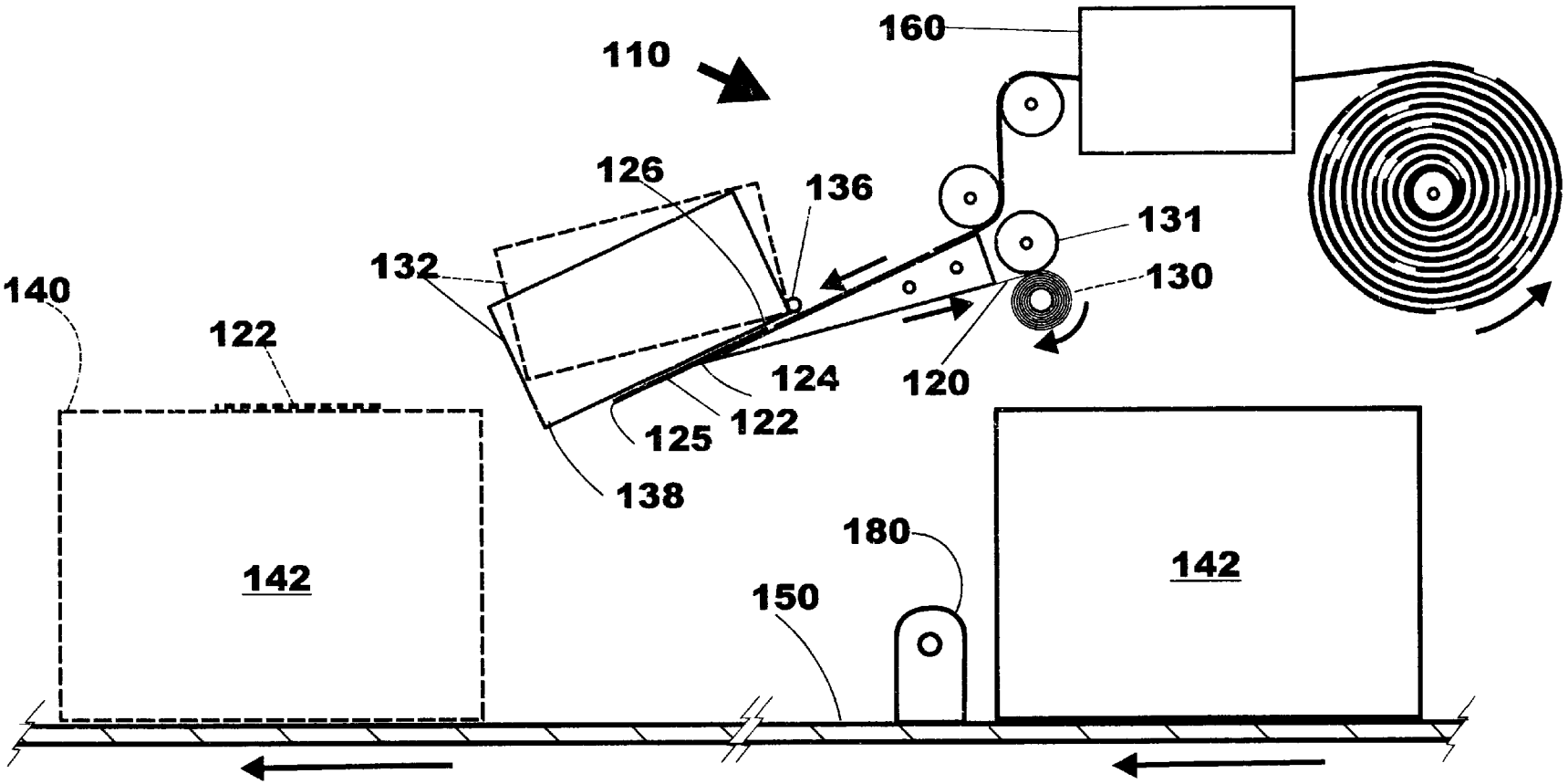
FIG. 1 illustrates schematically an automatic labeling station of this invention.
Figure 3:
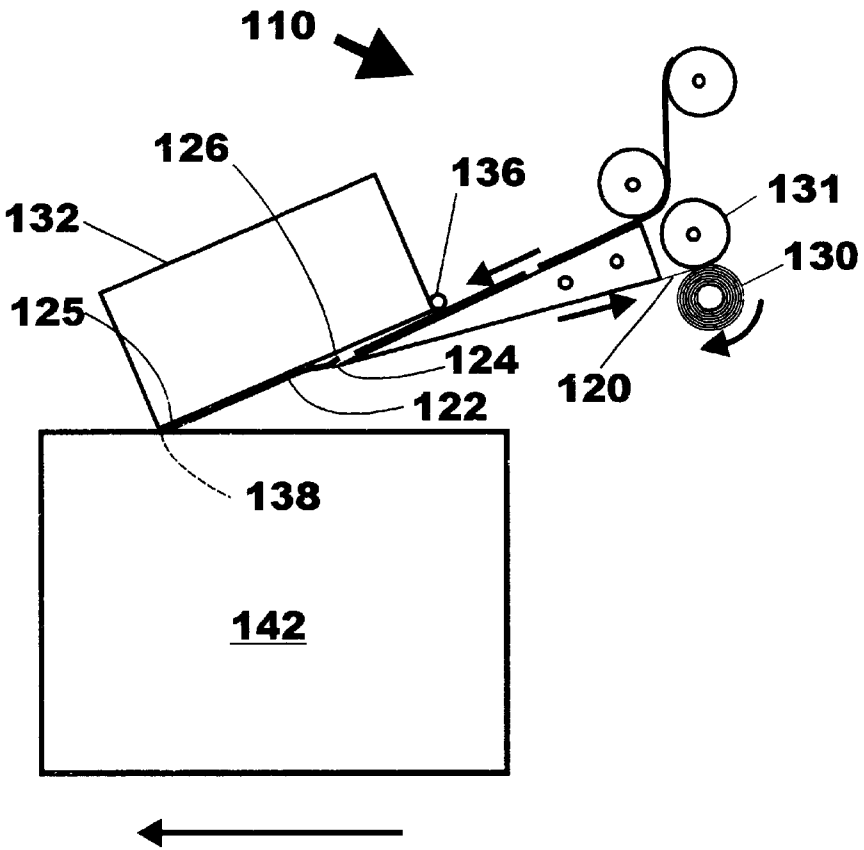
FIG. 3 illustrates schematically a detail of the labeling station of this invention.
Figure 2:
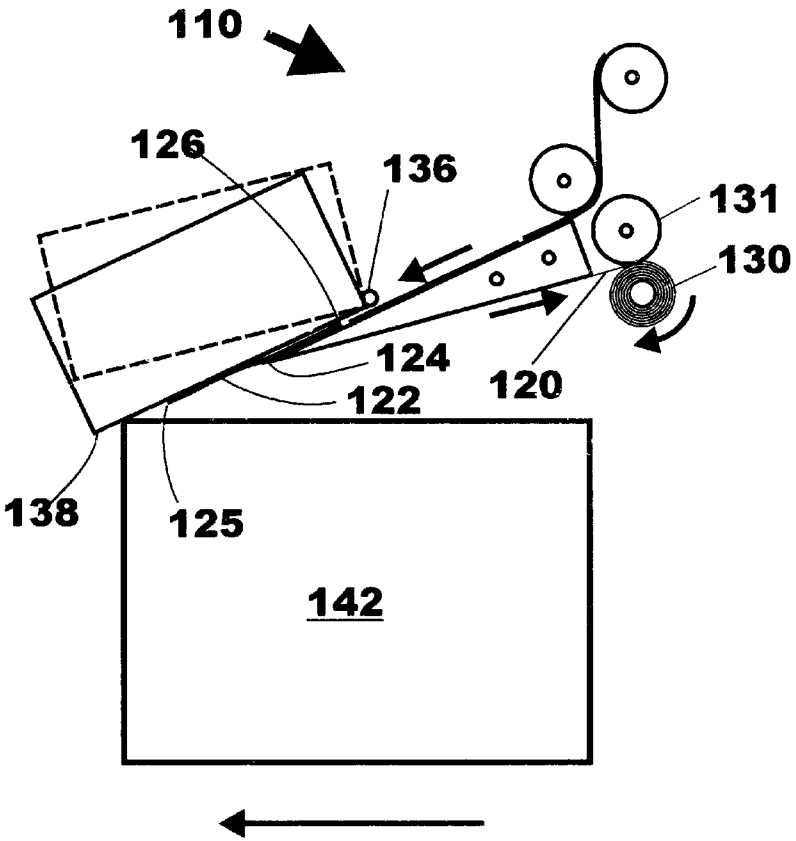
FIG. 2 illustrates schematically a detail of the labeling station of this invention.

The elements of the merge labeling apparatus 110 of this invention is shown schematically in FIG. 1 and in FIGS. 2 and 3. A liner 120 carries a supply of individual labels 122 over a peeling device 124 that causes a sharp change in direction of the liner 120 that separates the label from the liner as the liner is advanced around the peeling edge to a take-up reel 130. In most instances a take-up reel is merely a tension reel, lacking sufficient force to advance the liner. As shown here, the take-up reel 130 is coupled with a drive wheel.131 to provide an alternative means to advance the labels by driving the liner 120. In many systems, the drive means to advance the labels is a printer 160, shown here also. As the labels 122 are thus dispensed individually from the peeling edge 124, the portion of the label that is freed from the liner is supported on the surface of a fan box 132. A fan box 132 is merely a small box fan with a face plate on its suction side. The face plate has at least one face plate suction orifice on the exterior surface thereof. It holds the labels against the face plate by suction.

In the practice of this invention, as each label 122 is dispensed, the advance of the liner 120 is halted while the trailing edge 126 of the label is still attached thereto, with most of the label being supported on the fan box 132. The label 122 remains in this parked position until a sensor 180 along the conveyer belt 150 indicates that a carton 142 is arriving at the labeling station. The fan box 132 swings on a pivot axis 136 when the carton arrives and pushes it away, and the lower distal edge that creates a pinch point 138 between the fan box 132 and the surface of the carton 142 can wipe across the label as the carton 142 passes. This pinch point may include a brush or softedged wiper, not shown here, to smooth the applied label. At a time determined from the position of the sensor 180 and the speed of the conveyer belt 150 carrying the carton 142, the parked label is again advanced by movement of the liner 120 so the leading edge 125 of the label reaches the pinch point 138 on the fan box 132 at a time commensurate with the desired positioning of the label along the length of the carton. This advance may begin before the carton reaches the fan box. The timing of this advance can be provided by means of an adjustable electronic time-delay circuit, details of which are common and not a part of this invention, or more simply, merely by adjusting the positioning of the carton sensor 180. The result is what might be called a "just-in-time delivery" of the label to the pinch point 138 at just the time the appropriate location along the length of the carton 142 also arrives at the pinch point 138. This pinch point may include a brush or soft-edged wiper, not shown here, to smooth the applied label.

A printing device 160 may be used to print indicia on labels before they are dispensed. The printer may print simultaneously with the advance of the liner and may, indeed, be the driving force for advancing the liner. The indicia being printed may be specific to a carton scheduled for later arrival at the labeling station. This invention overcomes a deficiency existing in prior art apparatus wherein the speed at which the labels can be printed determines the maximum speed of the conveyer belt carrying the cartons to be labeled, which can cause a bottleneck in a production line. What is identified here as a printing device 160 may be used as or substituted by a drive device for advancing the labels with no printing operation involved at all.

Printers of the type often used for preparing high-quality customized labels in merge labeling operations are not generally considered as high-speed printers. Quality is more important than speed. Linear speed of labels from such high-quality printers are often in the range of two to eight inches per second, but these data should not be interpreted as limiting this invention. Suffice it to say that in testing using a printer with a maximum label printing speed producing a linear speed of eight inches per second (which is equivalent to 40 feet per minute), the method of this invention has accurately and with precision placed labels repeatedly in the same position on cartons moving at linear speeds up to more than one hundred feet per minute, the maximum speed at which the test equipment would operate. No upper limit to the speed ratio of carton speed to label advance speed is anticipated.

No lower limit to the speed ratio of carton speed to label advance speed is anticipated, either. The length of label still attached to the liner when the leading edge of the label reaches the pinch point is so small that the label will not bunch up as the liner dispenses the trailing edge and frees it from contact with the liner. The distance from the peel edge to the pinch point can be adjusted to accommodate even the slowest imaginable carton speed.

In many prior art devices, because a significant portion of the label is still adhering to the liner when the label adheres to a moving carton, the linear speed of the carton must match the linear speed of the advancing label as it is driven by the liner, lest the label or the liner be damaged as a result of a speed mismatch. If the label moves too fast relative to the carton, it can wrinkle or bunch up on the carton; if it moves too slow, the label or the liner may be torn. These deficiencies are overcome by the present invention.

When the adhesive back of the label 122 contacts the carton 142 and adhesion is developed there, the trailing edge 126 of the label is barely attached to the liner 120. This attachment is so slight that it is easily broken without damage to the label or the liner, even if the linear speed of the carton 142 is much higher than the linear speed of the liner 120.

Looking now at FIG. 2, a carton 142 having previously triggered the sensor 180 of FIG. 1 arrives at the fan box 132 while the label 122 is still in a parked position on the fan box 132. No contact between the label and the carton is effected yet. A short time later, as shown in FIG. 3, the carton 142 has been carried farther along and the pinch point rides atop the carton and the label feed is occurring so that the leading edge of the label has reached the pinch point 138 to place the label at the desired location along the length of the carton, making contact therewith to adhere thereto and to have only the slightest portion of the trailing edge of the label peeled from adhesion to the liner 120 at the peel edge 124 and drawn from the mild vacuum grip of the fan box 132. The liner may then be advanced to place the next label at the park position on the fan box 132.

The advantage of this process is that the linear speed of the carton passing the labeling station is not limited by the linear speed of the advance of the liner. The carton may be moving much faster than the speed of the liner without doing damage to the liner or the label being applied. The position at which the label is applied to the carton, as measured from the leading edge of the carton, is easily adjusted in a direct linear fashion by the adjusting of the position of the carton sensor 180. Alternatively, an electronic time-delay circuit can be integrated with the carton sensor or with the label printer 160 to delay the advance of the liner carrying the labels, thereby to provide adjustment of the label positioning. The former is the preferred approach, however.

Figure 4:
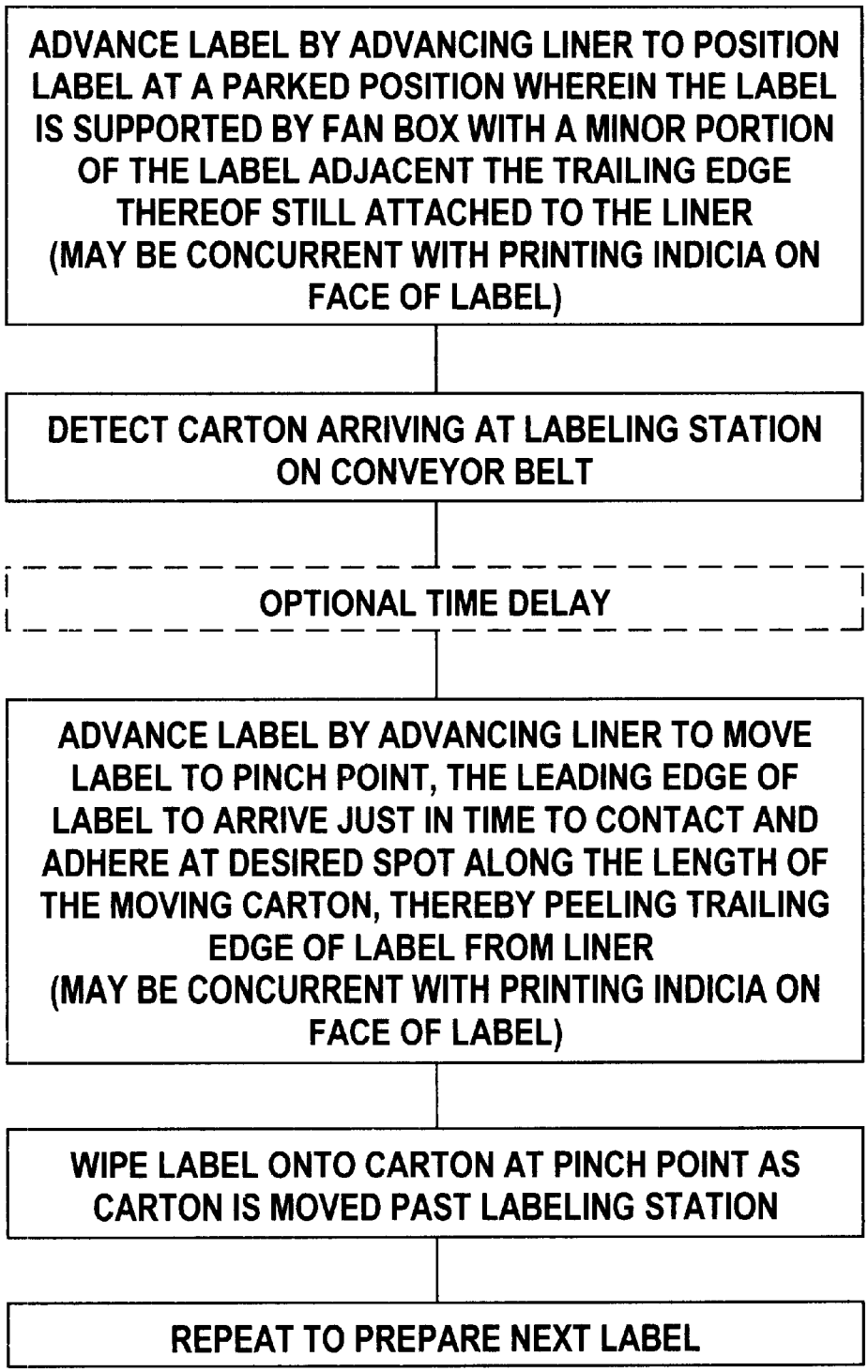
FIG. 4 shows the process steps in the labeling process of this invention.

FIG. 4 presents the steps in the process of this invention. These steps include:

Advance label by advancing liner to position label at a parked position wherein the label is supported by fan box with a minor portion of the label adjacent the trailing edge thereof still attached to the liner; detect carton arriving at labeling station on conveyor belt; optional time delay; advance label by advancing liner to move label to pinch point, the leading edge of label to arrive just in time to contact and adhere at desired spot along the length of the moving carton, thereby peeling trailing edge of label from liner; wipe label onto carton at pinch point as carton is moved past labeling station; and repeat to prepare next label.

Whereas this description has described in detail the applying of labels to cartons, it should be understood that this terminology is used for a concrete example only. For purposes of this application, the word "carton" may be interpreted to mean any package or article upon which a label is to be applied. Similarly, a carton sensor is to be broadly interpreted. Such a sensor may be a physical arrangement of a trip arm and a switch; a light- or sound-beam device operating on either an interrupted beam, a beam reflected from the carton, or a beam radiated from the carton, as an infra-red sensor; or a mass- or weight-sensing device. Examples of all of these are known in various art fields and the details of their operation are not specifically a part of this invention.

What is claimed is:

1. Apparatus for automatically and with precision applying pressure-sensitive labels in a merge-labeling operation, said labels each having a leading edge, a trailing edge, an adhesive back, and a non-adhesive face, said apparatus comprising in combination:

a. a fan box assembly having a face plate thereof on the negative pressure side of an incorporated fan for generating a negative pressure, said face plate having at least one face plate suction orifice on the exterior surface of said face plate, said negative pressure being sufficient to hold in slidable fashion against said face plate said face of a pressure-sensitive label as said label is peeled from a continuous liner upon which it is releasably adhered by adhesive on the back of said label, said fan box mounted on a pivot axis parallel to the plane of said face plate and said fan box having at the distal end of said face plate an edge that forms a pinch point with a surface of a carton passing said edge;

b. a label separator edge having a peel line adjacent said fan box face plate and parallel to said face plate, said peel line for partially dispensing onto said fan box said pressure-sensitive label from said continuous liner that wraps around said edge from a substantially continuous supply to a take-up reel;

c. means for a first advancing of said liner to move said label to a parked position wherein said label receives physical support from said fan box, owing to said negative pressure therein, but is still attached to said liner by an area adjacent said trailing edge;

d. means for a second advancing of said liner at a first linear speed to move said label from said parked position to arrive at said pinch point just in time for said leading edge to merge with and adhere to a surface of said carton at a preselected distance from a leading edge of said carton when a smaller area adjacent said trailing edge is still in contact with said liner, said carton moving at a second linear speed different from said first linear speed and drawing said adhered label from attachment to said liner and beneath said pinch point to wipe said pinch point across said face of said label, thereby to assure adhesion of said label to said surface;

e. sensor means for a carton approaching said fan box assembly to trigger said second advancing of said liner to effect said just-in-time arrival of said label.

2. The apparatus of claim 1 that also comprises means for printing indicia on said face of said label prior to dispensing thereof.

3. The apparatus of claim 2 wherein the printing speed of said means for printing limits said first linear speed.

4. The apparatus of claim 1 wherein said second speed is at greater than said first linear speed.

5. The apparatus of claim 1 wherein said second speed is less than said first linear speed.

* * * * *